US008783903B2

(12) United States Patent
Bhattacharya et al.

(10) Patent No.: US 8,783,903 B2
(45) Date of Patent: Jul. 22, 2014

(54) LIGHT-EMITTING ELECTRONIC TEXTILE WITH LIGHT-DIFFUSING MEMBER

(75) Inventors: Rabin Bhattacharya, Silver Spring, MD (US); Hugo Johan Cornelissen, Eindhoven (NL); Koen Van Os, Eindhoven (NL)

(73) Assignee: Koninklijke Philips N.V., Eindhoven (NL)

( * ) Notice: Subject to any disclaimer, the term of this patent is extended or adjusted under 35 U.S.C. 154(b) by 124 days.

(21) Appl. No.: 13/583,117

(22) PCT Filed: Mar. 2, 2011

(86) PCT No.: PCT/IB2011/050876

§ 371 (c)(1), (2), (4) Date: Sep. 6, 2012

(87) PCT Pub. No.: WO2011/110974

PCT Pub. Date: Sep. 15, 2011

(65) Prior Publication Data

US 2012/0327654 A1 Dec. 27, 2012

(30) Foreign Application Priority Data

Mar. 9, 2010 (EP) ..... 10155947.4

(51) Int. Cl.
*F21V 11/06* (2006.01)
*F21V 13/02* (2006.01)

(52) U.S. Cl.
USPC ..... 362/235; 362/249.06; 362/555; 362/556; 29/592.1

(58) Field of Classification Search
CPC ..... G90F 9/33; G90F 21/02; F21V 13/02; F21V 11/06
USPC ..... 362/235, 244, 249.06, 551, 554, 555, 362/556, 570; 29/592.1
See application file for complete search history.

(56) References Cited

U.S. PATENT DOCUMENTS

| | | | | |
|---|---|---|---|---|
| 5,256,468 | A * | 10/1993 | Wiener | 428/193 |
| 6,793,360 | B2 * | 9/2004 | Goslee | 362/84 |
| 7,144,830 | B2 | 12/2006 | Hill | |
| 7,234,853 | B2 * | 6/2007 | Givoletti | 362/556 |
| 7,592,276 | B2 * | 9/2009 | Hill et al. | 442/301 |
| 8,282,232 | B2 * | 10/2012 | Hsu et al. | 362/103 |
| 8,536,075 | B2 * | 9/2013 | Leonard | 442/301 |
| 2005/0142971 | A1 | 6/2005 | Chen | |

(Continued)

FOREIGN PATENT DOCUMENTS

| | | | |
|---|---|---|---|
| WO | 2006129246 | A2 | 12/2006 |
| WO | 2006129272 | A2 | 12/2006 |

(Continued)

*Primary Examiner* — John A Ward

(57) ABSTRACT

A light-emitting electronic textile (1;35) comprising: a flexible component carrier (2) having a plurality of light sources (3) arranged thereon; and at least one textile light-diffusing member (4) arranged to diffuse light emitted by the light sources (3). The textile light-diffusing member (4) comprises: a first textile layer (10) comprising fibers (14); a second textile layer (11) comprising fibers (15); and a spacing layer (12) arranged between the first textile layer (10) and the second textile layer (11), wherein the spacing layer (12) comprises spacing fibers (16) that space apart the first and second textile layers, the spacing fibers (16) being attached to fibers (14,15) comprised in each of the first and second textile layers to thereby mechanically connect the first (10) and second (11) textile layers with each other.

14 Claims, 4 Drawing Sheets

(56) References Cited

U.S. PATENT DOCUMENTS

| | | | | |
|---|---|---|---|---|
| 2006/0007059 | A1 | 1/2006 | Bell | |
| 2008/0198620 | A1* | 8/2008 | Bihr et al. | 362/603 |
| 2010/0271805 | A1* | 10/2010 | Van Herpen | 362/84 |
| 2013/0176737 | A1* | 7/2013 | Zhou et al. | 362/249.06 |

FOREIGN PATENT DOCUMENTS

| | | | |
|---|---|---|---|
| WO | 2007141726 | A1 | 12/2007 |
| WO | 2008152558 | A1 | 12/2008 |
| WO | 2009050629 | A1 | 4/2009 |

* cited by examiner

LIGHT-EMITTING ELECTRONIC TEXTILE WITH LIGHT-DIFFUSING MEMBER

FIELD OF THE INVENTION

The present invention relates to a light-emitting electronic textile with a textile light-diffusing member, and to a textile substrate.

BACKGROUND OF THE INVENTION

Many types of textiles are used in our every-day life. When electronics are unobtrusively integrated into these textiles (to create electronic textiles), new application fields emerge. One such example of a new application is light-emitting textiles, and other examples include textile-based sensing systems etc.

Existing electronic textiles typically comprise a flexible component carrier on which electronic components are mounted, and a cover textile sheet arranged on top of the electronic components in order to provide the desired textile look-and-feel to the electronic textile. For various applications, such as light-emitting electronic textiles and textile-based pressure sensing systems etc., the electronic textiles often include an additional textile layer arranged between the flexible component carrier and the cover textile sheet. This additional textile layer may provide different functionalities depending on application. In the case of a light-emitting electronic textile, the additional textile layer may, for example, be a diffuser layer.

WO 2006/129246 discloses one example of an electronic textile with such an additional textile layer arranged between a component carrier and a cover textile sheet. WO 2006/129246 discloses a light-emitting electronic textile with a component carrier in the form of a flexible substrate having a plurality of electronic components attached thereto. The light-emitting electronic textile according to WO 2006/129246 further comprises a diffusing element formed by two layers of non-woven fabric with different densities, and on top of the diffuser, there is provided a layer of fabric to give the light-emitting electronic textile a traditional fabric feel.

Although WO 2006/129246 provides an electronic textile with the desired textile-like mechanical properties, concealed electronic components and light-diffusion, there still appears to be room for improvements, in particular in terms of the reliability of an electronic textile.

SUMMARY OF THE INVENTION

In view of the above-mentioned and other drawbacks of the prior art, a general object of the present invention is to provide an improved light-emitting electronic textile and in particular a light-emitting electronic textile enabling efficient output of light while providing for an improved reliability and/or lifetime of the light-emitting electronic textile.

According to a first aspect of the present invention there is provided a light-emitting electronic textile comprising: a flexible component carrier having a plurality of light sources arranged thereon; and at least one textile light-diffusing member arranged to diffuse light emitted by the light sources, wherein the textile light-diffusing member comprises: a first textile layer comprising fibers; a second textile layer comprising fibers; and a spacing layer arranged between the first textile layer and the second textile layer, wherein the spacing layer comprises spacing fibers that space apart the first and second textile layers, the spacing fibers being attached to fibers comprised in each of the first and second textile layers to thereby mechanically connect the first and second textile layers with each other.

By "textile" should, in the context of the present application, be understood a material or product that is wholly or partly made of fibers. The fibers may be provided in the form of single fibers/filaments, or maybe bundled together in a multi-fiber configuration, such as a yarn. The textile may, for example, be manufactured by means of weaving, braiding, knitting, crocheting, quilting, or felting. In particular, a textile may be woven or non-woven.

Moreover, the flexible component carrier may, for example, comprise a flexible printed circuit board or a textile substrate comprising conductor lines. Such a textile substrate may, for example, be formed using interwoven conductive and non-conductive yarns.

The present invention is based on the realization that diffusion of the light emitted by the light sources, as well as efficient handling of the heat generated by the light sources (and/or other electronic components that may be comprised in an electronic textile) can be achieved through the use of a so-called 3D-fabric. In a 3D-fabric, a first textile layer with fibers is spaced apart from a second textile layer with fibers by means of a spacing layer arranged between the first textile layer and the second textile layer. The spacing layer comprises spacing fibers that space apart the first and second textile layers, and these spacing fibers are attached to fibers comprised in each of the first and second textile layers to thereby mechanically connect the first and second textile layers with each other. Through this structure, a light-diffusing structure is formed, which allows for a certain flow of air, at least in the spacing layer. This flow of air can carry away heat generated by electronic components, such as the light sources.

Since the heat generated by the electronic components in the electronic textile can be carried away more efficiently than is the case when conventional light-diffusers (typically made of a non-woven textile material or foam) are used, the reliability and/or the life-time of the electronic components can be increased or other types of cooling can be dispensed with.

Furthermore, the textile light-diffusing member comprised in the light-emitting electronic textile according to various embodiments of the present invention can protect the light sources and/or other electronic components from mechanical wear and tear. For example, the structure of the textile light-diffusing member facilitates for the designer of the electronic textile to tailor the mechanical properties of the textile light-diffusing member. For instance, the response of the textile light-diffusing member to stress acting on the light-emitting electronic textile can be controlled through selection of the properties and/or density of the spacing fibers. The response of the textile light-diffusing member may, for example, include the response of the textile light-diffusing member to plane stress and/or shear stress.

Moreover, a relatively strong damping of stress applied to the light-emitting electronic textile can be achieved using a relatively thin light-diffusing member, as compared to the case with conventional textile light-diffusers.

It should be noted that the light-emitting electronic textile according to the present invention may advantageously be substantially sheet-shaped, which means that the lateral dimensions of the light-emitting electronic textile (in two dimensions) are substantially larger than the thickness thereof. For example, the thickness of the light-emitting electronic textile may be less than one tenth of the smallest lateral dimension (length/width) thereof.

The spacing fibers in the spacing layer may be attached to the fibers comprised in each of the first and second textile layers by forming loops around the fibers.

According to various embodiments, the flexible component carrier may comprise the first textile layer. In these embodiments, the light sources are thus arranged on the first textile layer. The light sources may be arranged on either side of the first textile layer, or may be embedded in the first textile layer.

Advantageously, at least one of the light sources may be arranged to emit light through the spacing layer and the second textile layer.

Furthermore, at least one of the light sources may be arranged to emit light through the first textile layer, the spacing layer and the second textile layer.

According to one exemplary embodiment, the first textile layer may comprise a conductive pattern configured to allow electrical connection of the light sources thereto.

This conductive pattern may be formed by at least one conductive fiber. For example, the conductive pattern may be formed by at least one conductive yarn. Alternatively, the conductive pattern may be printed or plated (electro-plated or electroless-plated), or the conductive pattern may be formed by a combination of at least one conductive fiber and a printed or plated conductive pattern portion.

Moreover, the light-emitting textile according to various embodiments of the present invention may comprise at least one conductive fiber passing from the first textile layer to the second textile layer, through the spacing layer. Hereby, selected light sources and/or other electronic components may be interconnected by means of the conductive fiber that passes through the spacing layer. This allows for crossing conductors without the need for a flexible component carrier with multiple conductive layers.

Advantageously, furthermore, the conductive fiber may pass back from the second textile layer to the first textile layer, through the spacing layer.

Having a conductive fiber passing from the first textile layer to the second textile layer (and, where applicable, back to the first textile layer) may be particularly useful in embodiments where the first textile layer comprises at least one conductive fiber. The conductive fiber passing through the spacing layer may then interact with the conductive fiber in the first textile layer to enable electrical access to one or several light sources from the second textile layer.

According to various embodiments of the present invention, the second textile layer may comprise a conductive pattern configured to allow electrical connection of electronic components thereto, whereby more complex electronic textiles can be provided.

Moreover, the light-emitting electronic textile according to the invention may further comprise a third textile layer comprising fibers; and a second spacing layer arranged between the first textile layer and the third textile layer, wherein the second spacing layer comprises spacing fibers that space apart the first and third textile layers, the spacing fibers being attached to fibers comprised in each of the first and third textile layers to thereby mechanically connect the first and third textile layers with each other.

According to yet another embodiment, the light-emitting electronic textile may comprise a first textile light-diffusing member arranged to diffuse light emitted by a first set of light sources, and a second textile light-diffusing member arranged to diffuse light emitted by a second set of light sources, different from said first set of light sources. The first and second light-diffusing members may advantageously comprise a first textile layer comprising fibers; a second textile layer comprising fibers; and a spacing layer arranged between the first textile layer and the second textile layer, wherein the spacing layer comprises spacing fibers that space apart the first and second textile layers, the spacing fibers being attached to fibers comprised in each of the first and second textile layers to thereby mechanically connect the first and second textile layers with each other.

The light sources comprised in the light-emitting electronic textile may advantageously be light-emitting diodes.

According to a second aspect of the present invention, there is provided a textile substrate for use in a light-emitting electronic textile further comprising a plurality of light sources, the textile substrate comprising: a first textile layer comprising fibers and a conductive pattern configured to allow electrical connection of the light sources thereto; a second textile layer comprising fibers; and a spacing layer arranged between the first textile layer and the second textile layer, wherein the spacing layer comprises spacing fibers that space apart the first and second textile layers, the textile fibers being attached to fibers comprised in each of the first and second textile layers to thereby mechanically connect the first and second textile layers with each other.

Variations and advantages of this second aspect of the present invention are largely analogous to those provided above in connection with the first aspect of the invention.

BRIEF DESCRIPTION OF THE DRAWINGS

These and other aspects of the present invention will now be described in more detail, with reference to the appended drawings showing currently preferred embodiments of the invention, wherein.

DESCRIPTION OF A PREFERRED EMBODIMENT OF THE PRESENT INVENTION

In the following description, the present invention is described with reference to a light-emitting electronic textile in which the flexible light-diffusing member is formed by a so-called 3D-fabric with first and second knitted textile layers and a spacing layer comprising a yarn forming loops around yarns in the first and second textile layers to hold together and space apart the first and second textile layers. In the various illustrated embodiments, the yarn in the spacing layer is shown as being thicker than the yarns in the first and second textile layers, and a certain exemplary density and configuration of the spacing layer is provided.

It should be noted that this by no means limits the scope of the invention, which is equally applicable to other light-emitting electronic textiles having other flexible light-diffusing members with first and second textile layers that are held together and spaced apart by textile fibers. For example, the first and/or second textile layer may be woven, and the spacing layer may be formed by textile fibers that are thinner or thicker than any yarns in the first and second textile layers. Furthermore, the density of the textile fibers in the spacing layer may be higher or lower than what is illustrated in the figures depending on, for example, the desired mechanical and/or light-diffusion properties of the flexible light-diffusing member.

Figure 1:
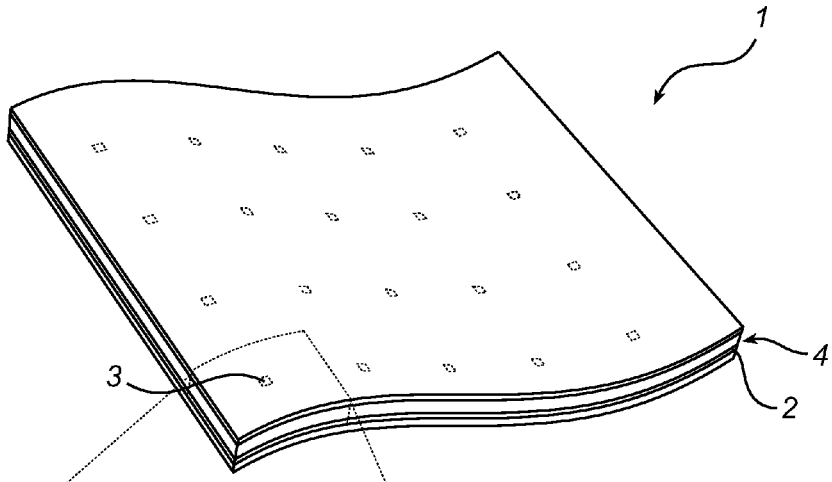
FIG. 1 is a schematic perspective view of an exemplary light-emitting electronic textile.

FIG. 1 schematically illustrates a light-emitting electronic textile 1, comprising a flexible component carrier 2 having a plurality of light sources 3 (for the sake of clarity of drawing, only one of the light sources is indicated by a reference numeral) arranged thereon, and a flexible light-diffusing member, in the form of a so-called 3D-fabric 4 arranged to allow the light sources 3 to emit light through the light-diffusing member 4, such that the emitted light is diffused before exiting the light-emitting electronic textile 1 The light sources 3 may advantageously be light-emitting diodes (LEDs).

The light-diffusing member 4 diffuses the light emitted by the light sources 3 to ensure that the light is spread out over a larger area. In some applications, the flexible light-diffusing member 4 may also act as a shock-absorbing layer to prevent damage to the light sources 3 and/or other electronic components resulting from external forces.

In the following, various examples of configurations of the light-emitting electronic textile 1 in FIG. 1 will be described with reference to FIGS. 3 to 7.

Figure 2:
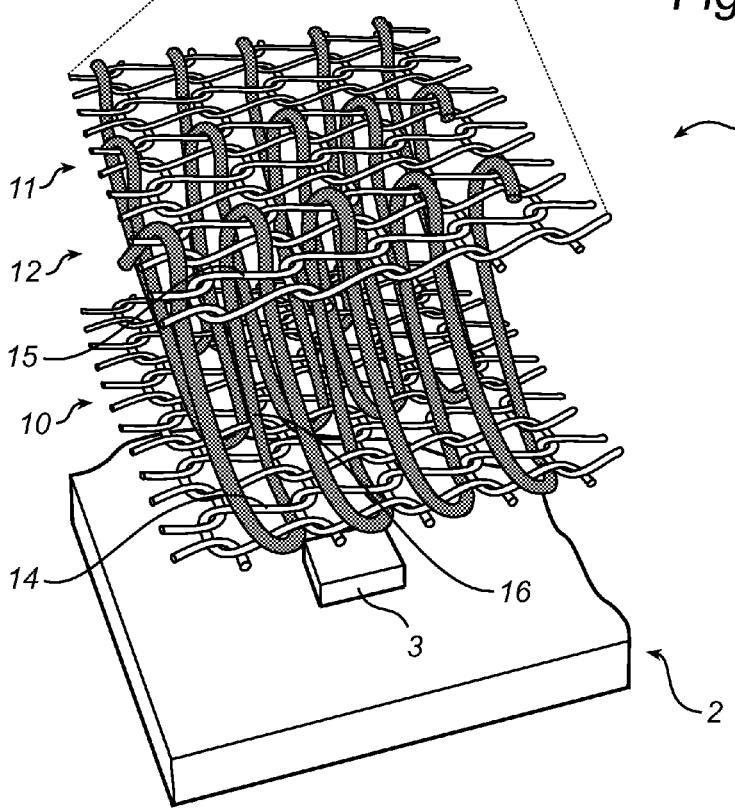
FIG. 2 schematically illustrates a portion of the light-emitting electronic textile arrangement in FIG. 1 according to a first exemplary embodiment.

First, with reference to FIG. 2, a portion of the light-emitting electronic textile in FIG. 1 will be described, in which the light sources 3 and/or other electronic components are arranged on a separate flexible component carrier 2, and a flexible light-diffusing member 4 is arranged on top of the light sources 3 as is schematically indicated in FIG. 2.

The flexible light-diffusing member 4 is shown in the form of a so-called 3D-fabric comprising a first textile layer 10 and a second textile layer 11, that are spaced apart and held together by a spacing layer 12. In the exemplary embodiment that is schematically illustrated in FIG. 2, the first textile layer 10 is a first knit formed by yarns 14, and the second textile layer 11 is a second knit formed by yarns 15. The spacing layer is formed by a spacing yarn 16 that forms loops around the yarns 14, 15 in the first 10 and second 11 textile layers, respectively. Through this configuration of the spacing layer 12, a resilient yet relatively open structure is formed, which allows air to flow through the spacing layer 12, at least along the spacing layer 12. This provides for improved cooling of the light sources 3 as compared to when conventional light-diffusing materials are used. Through the improved cooling, an improved reliability and/or life-time of the light sources 3 is provided for. Depending on the configuration of the first textile layer 10 and/or the second textile layer 11, air may also be allowed to flow relatively freely through the entire light-diffusing member 4.

Figure 3:
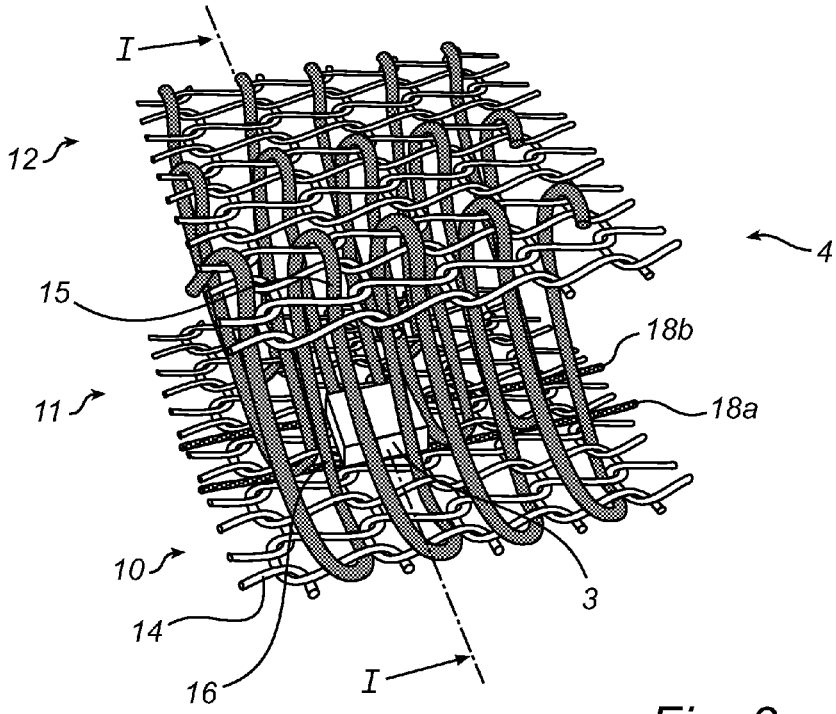
FIG. 3 schematically illustrates a portion of the light-emitting electronic textile arrangement in FIG. 1 according to a second exemplary embodiment.

Second, with reference to FIG. 3, a portion of the light-emitting electronic textile in FIG. 1 will be described, in which the flexible component carrier 2 comprises the first textile layer 10. In the particular exemplary embodiment that is schematically illustrated in FIG. 3, the first textile layer 10 comprises conductive yarns 18*a-b*, to which the light sources 3 are electrically connected. In FIG. 3, the light source 3 is illustrated as being arranged on the side of the first textile layer 10 facing the spacing layer 12. To arrange the light source 3 inside the 3D-fabric 4 as is schematically illustrated in FIG. 3, the light source 3 may, for example, be inserted through an opening formed in the first textile layer 10. The light source 3 may be electrically connected to the conductive yarns 18*a-b* on the side of the first textile layer 10 facing the spacing layer 12 as is schematically illustrated in FIG. 3. Alternatively, however, the light source 3 may be electrically connected to the conductive yarns 18*a-b* on the side of the first textile layer 10 facing away from the spacing layer 12. This may, for example, be achieved by means of a flexible connector passing through an opening in the first textile layer 10.

As will be readily understood by the person skilled in the relevant art, the light source 3 may alternatively be arranged on the side of the first textile layer 10 facing away from the spacing layer 12, and be oriented in such a way that light emitted by the light source 3 passes through the entire light-diffusing member 4, that is, through the first textile layer 10, the spacing layer 12 and the second textile layer 11.

It should be noted that the light-diffusing member 4 that is schematically illustrated in FIG. 3 may function as a textile substrate that would useable for several other electronic textile application not necessarily including light sources. I should be understood that the description below referring to FIGS. 4 to 6 apply to various embodiments of such a textile substrate with or without electronic components attached thereto.

Figure 4:
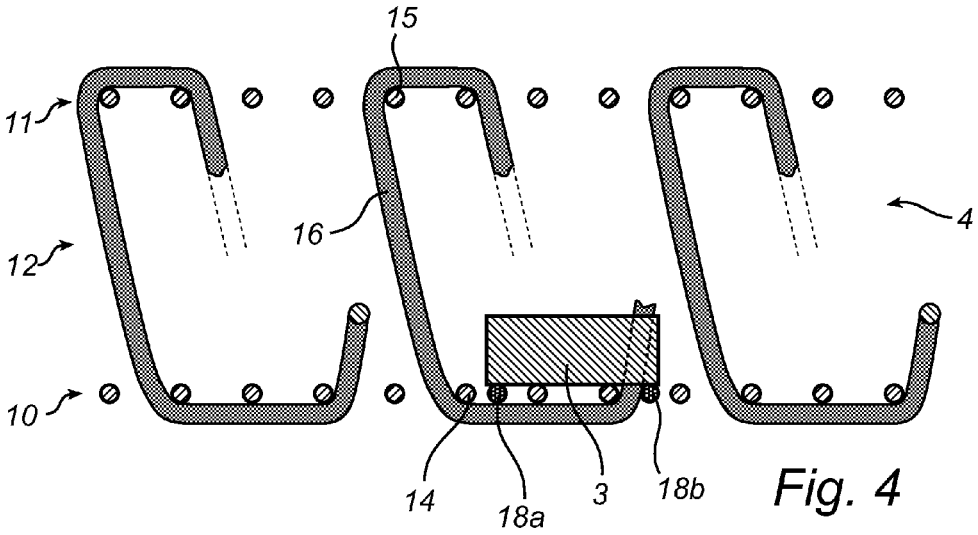
FIG. 4 is a perspective section view of the light-emitting electronic textile in FIG. 3.

FIG. 4 is a schematic perspective section view of the electronic textile in FIG. 3 taken along the line I-I in FIG. 3. FIG. 4 is not a "pure" section view, but has some depth to better illustrate an exemplary configuration of the spacing yarns 16 in the spacing layer 12.

As is schematically shown in FIG. 4, the light source 3 is electrically connected to the conductive yarns 18*a-b* in the first textile layer 10. The light source 3 could be electrically connected to the conductive yarns 18*a-b* and attached to the first textile layer 10 in various ways known to the skilled person, including, for example, soldering, cramping, glueing, welding etc., and no details such as solder pads or similar are shown in FIG. 4.

Figure 5:
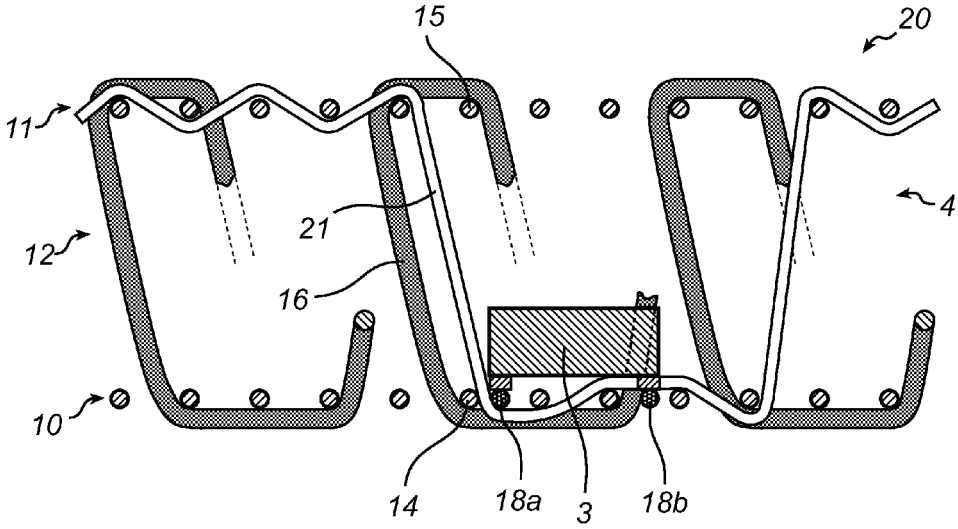
FIG. 5 is a perspective section view of another exemplary light-emitting electronic textile comprising a conductive yarn passing from the first textile layer to the second textile layer and back.

Turning now to FIG. 5, another exemplary light-emitting electronic textile 20 is shown, that differs from that shown in FIGS. 3 and 4, in that the light-emitting electronic textile 20 in FIG. 5 further comprises an additional conductive yarn 21 that passes from the second textile layer 11 to the first textile layer 10, and then back to the second textile layer 11. While in the first textile layer 10, the conductive yarn 21 is brought into electrical contact with one 18*a* of the conductive yarns in the first textile layer 10. Hereby, operation of the light source 3 can be controlled using, for example, a conductive yarn in the second textile layer 11 (not shown in FIG. 5). Alternatively or in combination, the configuration schematically illustrated in FIG. 5 can be used to enable crossing conductors or a pressure sensitive switch. In the case of a pressure sensitive switch, the additional conductive yarn 21 may be arranged to cross a conductor arranged in the first textile layer 10 in such a way that electrical contact between the conductor and the conductive yarn 21 can be achieved by compressing the 3D-fabric 4.

Figure 6:
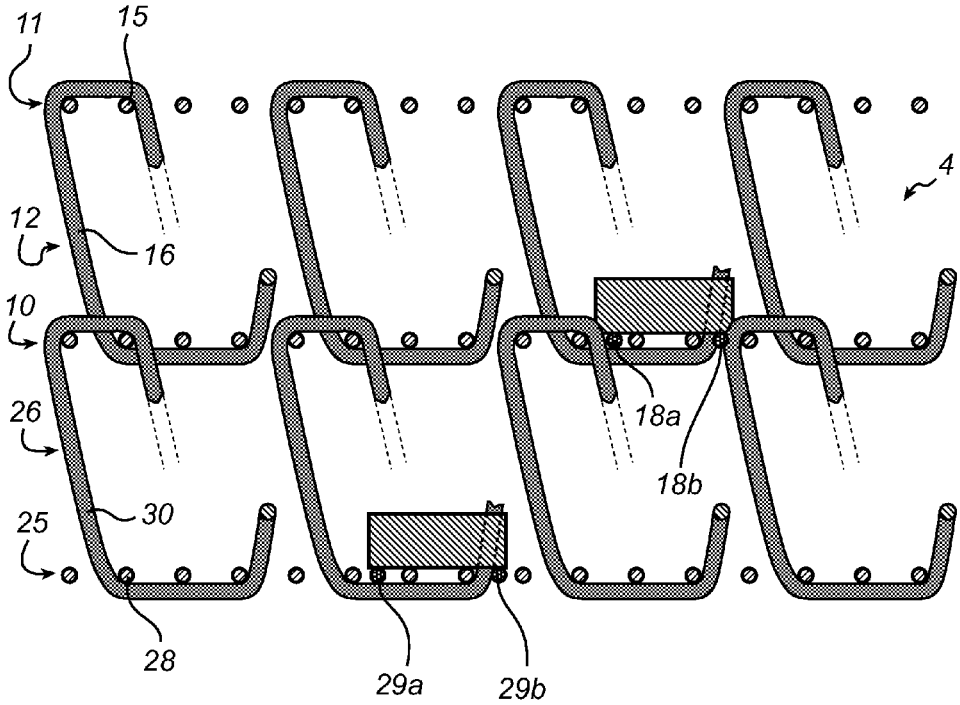
FIG. 6 is a perspective section view of another exemplary light-emitting electronic textile comprising a third textile layer spaced apart from the first textile layer by a second spacing layer.

As is schematically illustrated in FIG. 6, the light-diffusing member/textile substrate according to the various aspects of the present invention is not limited to the case with a single spacing layer 12 arranged between a first 10 and a second 11 textile layer. On the contrary, the light-diffusing member/textile substrate 4 may be a multi-layer 3D-fabric. In the exemplary embodiment of such a multi-layer 3D-fabric that is schematically illustrated in FIG. 6, a third textile layer 25 is spaced apart from the first textile layer 10 by a second spacing layer 26. Like the first textile layer 10, the third textile layer 25 comprises non-conductive yarns 28 and conductive yarns 29*a-b*, and the second spacing layer comprises a yarn 30 that forms loops around yarns 14 in the first textile layer 10 and yarns 28 in the third textile layer 25. In the configuration of FIG. 6, different light sources are arranged in different "levels", which will provide for different degrees of light diffusion for the different light sources. Alternatively or in combination, different light sources may be arranged on opposite sides of the first textile layer 10, whereby a light-emitting electronic textile with double-sided emission of diffuse light is formed.

Figure 7:
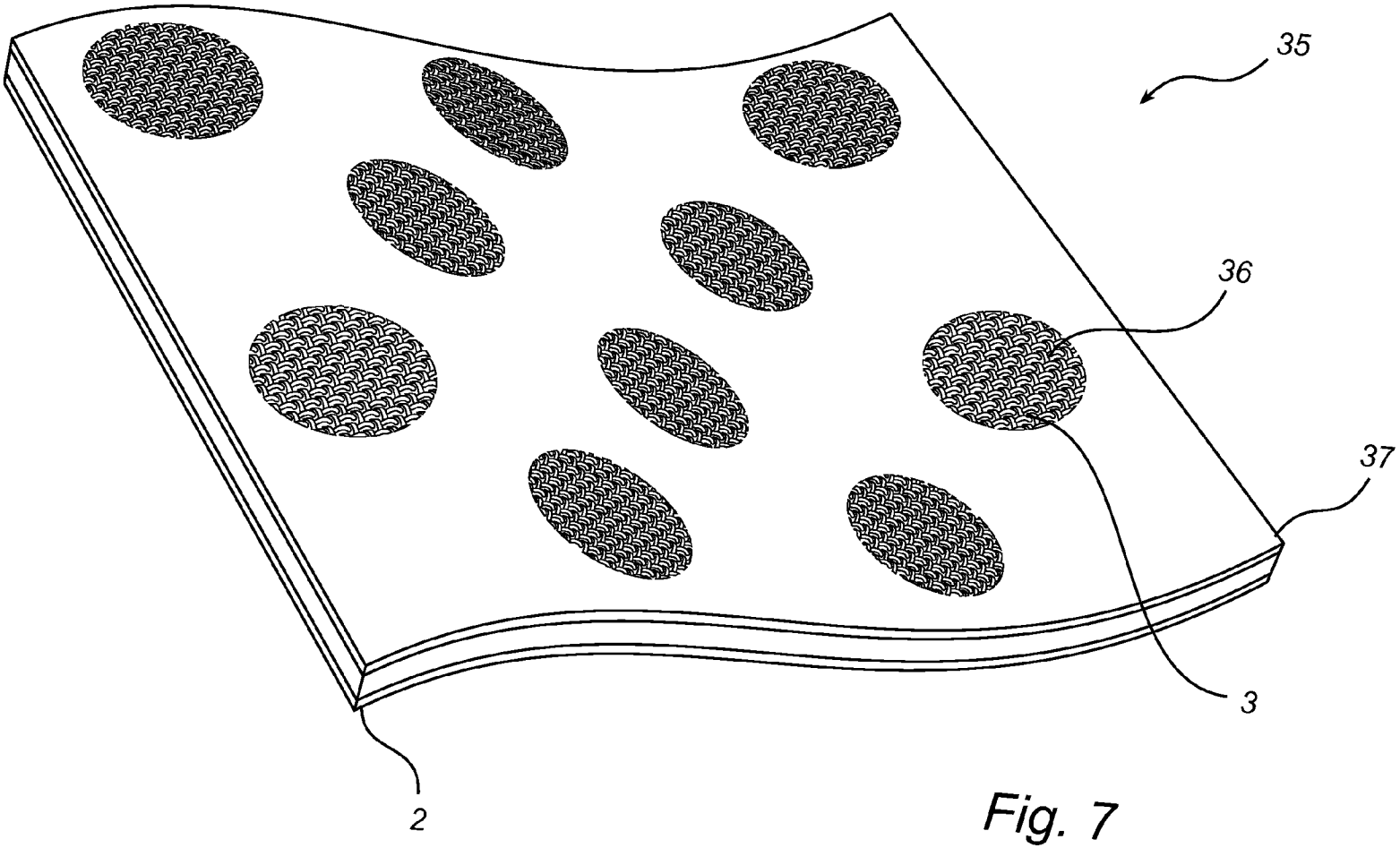
FIG. 7 is a schematic perspective view of an exemplary light-emitting electronic textile arrangement comprising light-diffuser patches arranged under a cover textile.

Finally, FIG. 7 schematically shows an exemplary light-emitting electronic textile arrangement 35 comprising light-diffuser patches 36 arranged under a cover textile 37. The light-diffuser patches 36 are formed by 3D-fabric which may, for example, have the configuration described above with reference to FIG. 2. By providing the light-diffuser in the form of 3D-fabric patches 36, light-diffusion can be made different for different light sources 3.

Additionally, variations to the disclosed embodiments can be understood and effected by the skilled person in practicing the claimed invention, from a study of the drawings, the disclosure, and the appended claims.

In the claims, the word "comprising" does not exclude other elements or steps, and the indefinite article "a" or "an" does not exclude a plurality. A single processor or other unit may fulfill the functions of several items recited in the claims. The mere fact that certain measures are recited in mutually different dependent claims does not indicate that a combination of these measured cannot be used to advantage.

The invention claimed is:

1. A light-emitting electronic textile (1; 35) comprising:
a flexible component carrier (2) having a plurality of light sources (3) arranged thereon; and
at least one textile light-diffusing member (4) arranged to diffuse light emitted by said light sources (3),
wherein said textile light-diffusing member (4) comprises:
a first textile layer (10) comprising fibers (14);
a second textile layer (11) comprising fibers (15); and
a spacing layer (12) arranged between said first textile layer (10) and said second textile layer (11),
wherein said spacing layer (12) comprises spacing fibers (16) that space apart said first and second textile layers,
said spacing fibers (16) being attached to fibers (14, 15) comprised in each of said first and second textile layers to thereby mechanically connect said first (10) and second (11) textile layers with each other.

2. The light-emitting electronic textile (1; 35) according to claim 1, wherein said spacing fibers (16) are attached to said fibers (14, 15) comprised in each of said first and second textile layers by forming loops around said fibers.

3. The light-emitting electronic textile (1; 35) according to claim 1, wherein said flexible component carrier comprises said first textile layer (10).

4. The light-emitting electronic textile (1; 35) according to claim 3, wherein at least one of said light sources (3) is arranged between said first and second textile layers said at least one light sources being arranged to emit light through said spacing layer and said second textile layer.

5. The light-emitting electronic textile (1; 35) according to claim 3, wherein at least one of said light sources (3) is arranged to emit light through said first textile layer, said spacing layer and said second textile layer.

6. The light-emitting electronic textile (1; 35) according to claim 3, wherein said first textile layer (10) comprises a conductive pattern (18*a-b*) configured to allow electrical connection of said light sources (3) thereto.

7. The light-emitting electronic textile (1; 35) according to claim 6, wherein said conductive pattern is formed by at least one conductive fiber (18*a-b*).

8. The light-emitting electronic textile (1; 35) according to claim 1, comprising at least one conductive fiber (21) passing from said first textile layer (10) to said second textile layer (11), through said spacing layer (12).

9. The light-emitting electronic textile (1; 35) according to claim 8, wherein said conductive fiber (21) passes back from said second textile layer (11) to said first textile layer (10), through said spacing layer (12).

10. The light-emitting electronic textile (1; 35) according to claim 1, wherein said second textile layer comprises a conductive pattern configured to allow electrical connection of electronic components thereto.

11. The light-emitting electronic textile (1; 35) according to claim 1, further comprising:
a third textile layer (25) comprising fibers (28); and
a second spacing layer (26) arranged between said first textile layer (10) and said third textile layer (25),
wherein said second spacing layer (26) comprises spacing fibers (30) that space apart said first (10) and third (25) textile layers,
said spacing fibers (30) being attached to fibers comprised in each of said first and third textile layers to thereby mechanically connect said first and third textile layers with each other.

12. The light-emitting electronic textile (35) according to claim 1, comprising a first flexible light-diffusing member (36) arranged to diffuse light emitted by a first set of light sources (3), and a second flexible light-diffusing member arranged to diffuse light emitted by a second set of light sources, different from said first set of light sources.

13. The light-emitting electronic textile (1; 35) according to claim 1, wherein said light sources are light-emitting diodes.

14. A textile substrate for use in a light-emitting electronic textile further comprising a plurality of light sources, said textile substrate comprising:
a first textile layer (10) comprising fibers (14) and a conductive pattern (18*a-b*) configured to allow electrical connection of said light sources (3) thereto;
a second textile layer (11) comprising fibers (15); and
a spacing layer (12) arranged between said first textile layer and said second textile layer,
wherein said spacing layer (12) comprises spacing fibers (16) that space apart said first and second textile layers,
said spacing fibers (16) being attached to fibers (14, 15) comprised in each of said first and second textile layers to thereby mechanically connect said first and second textile layers with each other.

* * * * *